US010505276B2

(12) United States Patent
Rashidian

(10) Patent No.: US 10,505,276 B2
(45) **Date of Patent: *Dec. 10, 2019**

(54) WIRELESS COMMUNICATIONS ASSEMBLY WITH INTEGRATED ACTIVE PHASED-ARRAY ANTENNA

(71) Applicant: PERASO TECHNOLOGIES INC., Toronto (CA)

(72) Inventor: Atabak Rashidian, North York (CA)

(73) Assignee: PERASO TECHNOLOGIES INC., Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/181,519

(22) Filed: Nov. 6, 2018

(65) Prior Publication Data

US 2019/0089049 A1 Mar. 21, 2019

Related U.S. Application Data

(63) Continuation of application No. 15/668,025, filed on Aug. 3, 2017, now Pat. No. 10,153,548.

(51) Int. Cl.

| | |
|---|---|
| ***H01Q 1/36*** | (2006.01) |
| ***H01Q 3/26*** | (2006.01) |
| ***H01Q 1/02*** | (2006.01) |
| ***H01Q 21/00*** | (2006.01) |

(52) U.S. Cl.

CPC ..... *H01Q 3/2682* (2013.01); *H01Q 1/02* (2013.01); *H01Q 3/26* (2013.01); *H01Q 21/0093* (2013.01)

(58) Field of Classification Search

CPC ..... H01Q 3/2682; H01Q 1/12; H01Q 1/38; H01Q 1/50; H05K 1/18; H05K 2201/10098; H05K 2201/049; H05K 1/141; H04B 17/12; H04B 17/17; G01R 29/10

USPC ..... 343/700 R

See application file for complete search history.

(56) References Cited

U.S. PATENT DOCUMENTS

| | | | | |
|---|---|---|---|---|
| 8,477,509 B2 * | 7/2013 | Snider | ..... | H04B 1/082 312/257.1 |
| 2014/0132475 A1 * | 5/2014 | Bhutani | ..... | H01Q 9/42 343/866 |

* cited by examiner

*Primary Examiner* — Jean B Jeanglaude
(74) *Attorney, Agent, or Firm* — Perry + Currier Inc.

(57) ABSTRACT

A wireless communication assembly includes: a primary support member defining a primary mounting surface with first and second electrical contacts; an antenna, adjacent to primary mounting surface perimeter, and a baseband controller, on the primary support member; primary signal paths between the baseband controller and the first contacts; primary feed lines between the second contacts and the antenna; a secondary support member carrying a radio controller and defining a secondary mounting surface with third electrical contacts and ports adjacent to a perimeter of the secondary mounting surface; secondary signal paths between the third contacts and the radio controller; secondary feed lines between the radio controller and the ports; the secondary mounting surface configured to engage with the primary mounting surface to connect the first contacts with the third contacts, and the second contacts with the ports.

20 Claims, 15 Drawing Sheets

WIRELESS COMMUNICATIONS ASSEMBLY WITH INTEGRATED ACTIVE PHASED-ARRAY ANTENNA

CROSS-REFERENCE TO RELATED APPLICATIONS

This application is a continuation of U.S. application Ser. No. 15/668,025, filed Aug. 3, 2017, the contents of which is incorporated herein by reference.

FIELD

The specification relates to a wireless communications assembly.

BACKGROUND

The performance of wireless antenna elements (e.g. printed antenna elements) is dependent on the precision of antenna geometry and on the characteristics of the dielectric materials supporting the antenna elements. Certain materials and fabrication processes have characteristics more suitable to use in supporting antenna elements. Such materials and processes, however, may be more costly to deploy than other materials and processes. Further, some such materials and processes may lead to mechanical defects, such as warping of antenna supports.

SUMMARY

An aspect of the specification provides a wireless communication assembly, comprising: a primary support member defining a primary mounting surface; the primary mounting surface having a first set of electrical contacts and a second set of electrical contacts; a baseband controller supported on the primary support member; an antenna supported on the primary support member adjacent to a perimeter of the primary mounting surface; a set of primary signal paths defined by the primary support member between the baseband controller and the first set of electrical contacts; a set of primary feed lines defined by the primary support member between the second set of electrical contacts and the antenna; a secondary support member carrying a radio controller and defining a secondary mounting surface; the secondary mounting surface having a third set of electrical contacts and a set of ports adjacent to a perimeter of the secondary mounting surface; a set of secondary signal paths defined by the secondary support member between the third set of electrical contacts and the radio controller; a set of secondary feed lines defined by the secondary support member between the radio controller and the set of ports; the secondary mounting surface configured to engage with the primary mounting surface to connect the first set of electrical contacts with the third set of electrical contacts, and the second set of electrical contacts with the set of ports.

BRIEF DESCRIPTIONS OF THE DRAWINGS

Embodiments are described with reference to the following figures, in which.

DETAILED DESCRIPTION

Figure 1:
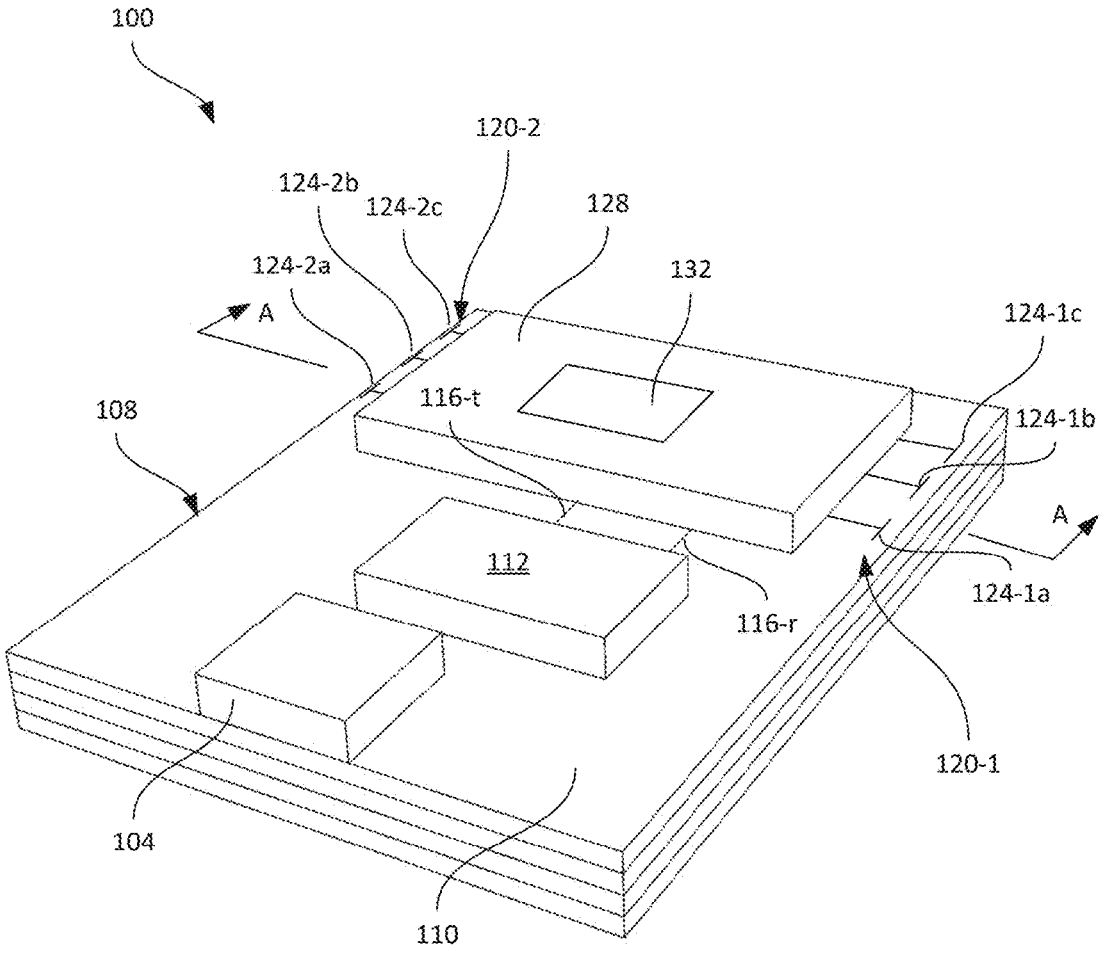
FIG. 1 depicts a wireless communications assembly.

FIG. 1 depicts an example wireless communications assembly 100 (also referred to simply as the assembly 100 herein) in accordance with the teachings of this disclosure. The assembly 100, in general, is configured to enable wireless data communications between computing devices (not shown). In the present example, the wireless data communications enabled by the assembly 100 are conducted according to the Institute of Electrical and Electronics Engineers (IEEE) 802.11ad standard, also referred to as WiGig, which employs frequencies of about 57 GHz to about 66 GHz. As will be apparent, however, the assembly 100 may also enable wireless communications according to other suitable standards, employing other frequency bands. The assembly 100 can be integrated with a computing device, or, as shown in FIG. 1, can be a discrete device that is removably connected to a computing device. As a result, the assembly 100 includes a communications interface 104, such as a Universal Serial Bus (USB) port, configured to connect the remaining components of the assembly 100 to a host computing device (not shown).

The assembly 100 includes a primary support member 108. In the present example, the primary support member 108 is a printed circuit board (PCB) carrying, either directly or via additional support members, as will be discussed in greater detail below, the remaining components of the assembly 100. In particular, the primary support member 108 carries, e.g. on an outer surface 110 thereof, the above-mentioned communications interface 104. The primary support member 108 also carries, on the surface 110, a baseband controller 112. The baseband controller 112 is implemented as a discrete integrated circuit (IC) in the present example, such as a field-programmable gate array (FPGA). In other examples, the baseband controller 112 may be implemented as two or more discrete components. In further examples, the baseband controller 112 is integrated within the primary support member 108.

In the present example, the baseband controller 112 is connected to the primary support member 108 via any suitable surface-mount package, such as a ball-grid array (BGA) package that electrically couples the baseband controller 112 to signal paths (also referred to as leads, traces and the like) formed within the primary support member 108 and connected to other components of the assembly 100. For example, the primary support member 108 defines signal paths (not shown) between the baseband controller 112 and the communications interface 104. Via such signal paths, the baseband controller 112 transmits data received at the assembly 100 to the communications interface for delivery to a host computing device, and also receives data from the host computing device for wireless transmission by the assembly 100 to another computing device. Further, the primary support member 108 defines a set of primary signals paths 116 extending between the baseband controller 112 and further components of the assembly 100, to be discussed below. Two primary signal paths 116 are shown in FIG. 1 for illustrative purposes: a transmit signal path 116-*t* configured to carry outgoing data from the baseband controller 112 for wireless transmission by the assembly 100, and a receive signal path 116-*r* configured to carry incoming data received wirelessly at the assembly 100 to the baseband controller 112. In other examples, other numbers of signal paths 116 can be provided.

The assembly 100 also includes an antenna supported on the primary support member 108. In the present example, two antennae 120-1 and 120-2 are illustrated, each including a plurality of antenna elements 124. More specifically, in the present example each of the antennae 120-1 and 120-2 is a phased array of three antenna elements 124, such as double-sided dipole antenna elements. Thus, the antenna 120-1 comprises antenna elements 124-1*a*, 124-1*b* and 124-1*c*, while the antenna 120-2 comprises antenna elements 124-2*a*, 124-2*b* and 124-2*c*.

Each antenna 120 is steerable independently of the other antenna 120. One or more additional antennae may also be included in other examples of the assembly 100. For example, a third phased array (not shown) may be supported on the surface 110 of the primary support member 108 along the edge of the surface 110 furthest from the communications interface 104. Further, as will be apparent, each phased array 120 need not include the same number of antenna elements 124 as shown in FIG. 1, nor is each phased array 120 required to have the same number of antenna elements 124 as the other phased array(s) 120 in any given implementation of the assembly 100.

Each antenna element 124 is a printed element in the present example. That is, the antenna elements 124 are supported on the primary support member 108 as a result of having been fabricated from one or more conductive layers of the primary support member 108 by any suitable combination of fabrication techniques. The antenna elements 124, in other words, are integrally formed with the primary support member 108 in the present example. As shown in FIG. 1, the antenna elements 124 are preferably supported on the outer surface 110 of the primary support member. In other examples, the antenna elements 124 may include circuit traces defined on an interior layer of the primary support member 108 (which, as illustrated, includes four layers of dielectric material with conductive material on either side of each dielectric layer; in other examples, greater or smaller numbers of layers may be employed) instead of, or in addition to, traces on the outer surface 110.

The assembly 100 also includes a secondary support member 128 carrying a radio controller 132 thereon. In the present example, the secondary support member 128 is a discrete component from the primary support member 108, and is configured for connection with the primary support member 108 via any suitable surface-mount package, such as a BGA package. The radio controller 132, which may also be referred to as a transceiver 132, includes one or more integrated circuits (e.g. an FPGA), and is generally configured to receive demodulated data signals from the baseband controller 112 (e.g., via the primary signal path 116-*t*) and encode the signals with a carrier frequency for application to one or more of the antennae 120 for wireless transmission. Further, the radio controller 132 is configured to receive signals from the antenna elements 124 corresponding to incoming wireless transmissions detected by the antenna elements 124, and to process those signals for transmission to the baseband controller 112 via the primary signal path 116-*r*.

The signal paths connecting the radio controller 132 and the antenna elements 124, which are also referred to as feed lines, will be discussed in greater detail below. In the present example, as shown in FIG. 1, the radio controller 132 is integrated with the secondary support member 128. That is, the secondary support member 128 and the radio controller 132 are portions of a printed circuit board, and may therefore both be fabricated by the same set of processes. In other examples, the radio controller 132 is fabricated as a discrete IC component from the secondary support member 128 and subsequently connected to the secondary support member 128, e.g. via flip-chip packaging technology.

Thus, as discussed above, the assembly 100 includes the primary support member 108 which carries the baseband controller 112 and the antenna elements 124, and the secondary support member 128 which carries the radio controller 132. In other words, the radio controller 132 is carried by a discrete component from the baseband controller 112 and the antenna elements 124, while the baseband controller 112 and the antenna elements 124 are carried by the same component. As will be discussed below, the assembly 100 has various structural features enabling the primary and secondary support members 108 and 128 to be assembled together to interconnect the baseband controller 112, the radio controller 132 and the antenna elements 124.

Figure 2:
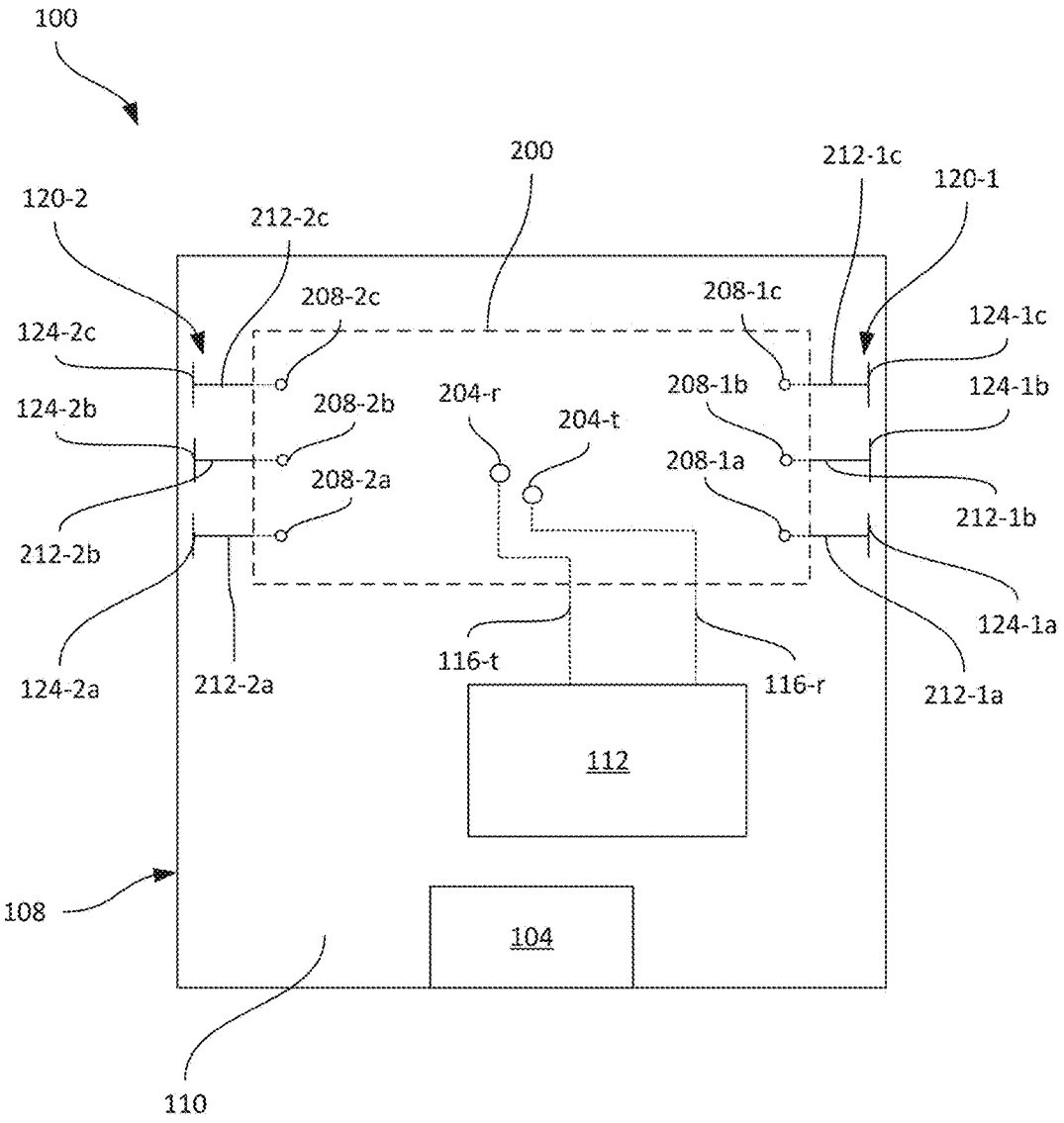
FIG. 2 depicts a top view of the wireless communications assembly of FIG. 1, omitting the secondary support member.

Turning to FIG. 2, a top plan view of the assembly 100 is shown, with the baseband controller 112 and the communications interface 104 carried on the outer surface 110, but with the secondary support member 128 and the radio controller 132 omitted. In other words, the assembly 100 is shown in a pre-assembled state in FIG. 2, before the secondary support member 128 has been connected to the primary support member 108.

As seen in FIG. 2, the primary support member 108 defines a primary mounting surface 200 on the outer surface 110. That is, in the present example, the primary mounting surface 200 is defined as a region of the same surface of the primary support member 108 on which the baseband controller 112, the communications interface 104 and the antennae 120 are supported. In other examples, the baseband controller 112 and the communications interface 104 need not be carried on the same surface as the primary mounting surface 200 (indeed, the baseband controller 112 and the communications interface 104 need not be carried on the same surface of the primary support member 108 as each other). The antennae 120, however, are preferably located on the same surface of the primary support member 108 as the primary mounting surface 200. In examples in which the antenna 120 include components (e.g. circuit traces) on an internal layer of the primary support member 108, such components are preferably closer to the outer surface 110 defining the primary mounting surface 200 than to the opposing surface of the primary support member 108 (not visible in FIG. 2).

The perimeter of the primary mounting surface 200 is shown in dashed lines in FIG. 2 for illustrative purposes. In some examples, the primary support member 108 includes a visual and/or physical indication of the perimeter of the primary mounting surface 200 (which need not be limited to dashed lines such as those shown in FIG. 2). In other examples, however, such a visual indication may be omitted. As will be seen below, certain structural features of the primary support member 108 also serve to visually indicate the perimeter of the primary mounting surface 200. Various features of the primary mounting surface 200 are described below as being included by or within the primary mounting surface 200. As will be apparent, features described in such a manner are features found on the primary support member 108 within the perimeter of the primary mounting surface 200.

The primary mounting surface 200 includes a first set of electrical contacts 204 and a second set of electrical contacts 208. More specifically, as seen in FIG. 2, the contacts 204 include a contact 204-*r* and a contact 204-*t*. The second set of contacts 208, meanwhile, includes contacts 208-1*a*, 208-1*b*, 208-1*c*, 208-2*a*, 208-2*b* and 208-2*c*. The electrical contacts 204 and 208 are conductive features on the outer surface 110 (and specifically, on the outer surface 110 within the perimeter of the primary mounting surface 200) that connect to conductive traces within the primary support member 108, as will be discussed below. The contacts 204 and 208 can be implemented, for example, as pads etched from a conductive layer on the outer surface 110 or deposited on the outer surface 110.

As noted above, the primary support member 108 also includes the primary signal paths 116. The paths 116 are shown in FIG. 2 extending between the baseband controller 112 and the electrical contacts 204. In other words, the primary signal paths 116 carry incoming and outgoing data between the baseband controller 112 and the radio controller 132 (via the electrical contacts 204 and the secondary support member 128). The primary signal paths 116 can be carried on the outer surface 110 along a portion of, or along the entirety of, their lengths. In other examples, the primary signal paths 116 can be carried within (i.e. on an internal layer of) the primary support member 108 along a portion of, or along the entirety of, their lengths. As will be apparent, greater or smaller numbers of primary signal paths 116 and contacts 204 can be implemented in other examples.

The primary support member 108 further includes a set of primary feed lines 212 between the second set of electrical contacts 208 and the antenna elements 124. Specifically, as shown in FIG. 2, the primary feed lines 212 include a feed line extending between each pair of an antenna element 124 and a contact 208. Thus, primary feed lines 212-1*a*, 212-1*b*, 212-1*c*, 212-2*a*, 212-2*b*, and 212-2*c* are shown in FIG. 2. In other examples, additional contacts 208 and corresponding primary feed lines can be provided for each antenna element 124. For example, each antenna element 124 may include a receive sub-element and a transmit sub-element (not shown), each with a distinct feed line 212 and corresponding contact 208.

As illustrated in FIG. 2, the antenna elements 124 are adjacent to the perimeter of the primary mounting surface 200. More specifically, the antenna elements 124 are externally adjacent to the perimeter (i.e. they are not supported on the primary mounting surface 200 itself). Further, the antenna elements 124 are also adjacent to a perimeter of the primary support member 108 itself. The contacts 208, on the other hand, are also adjacent to the perimeter of the primary mounting surface 200, but are internally adjacent to the perimeter. Therefore, the primary feed lines extend from within the perimeter of the primary mounting surface 200 to outside the perimeter of the primary mounting surface 200. The primary feed lines 212 may travel along the outer surface 110, or may travel below the outer surface 110, on one or more internal layers of the primary support member 108. In some examples, certain portions of the primary feed lines 212 are defined by internal layers while other portions of the primary feed lines 212 are defined on the outer surface 110.

The length of the primary feed lines 212 is preferably minimized. In particular, as will be evident through this disclosure, the primary support member 108 may be fabricated employing layers of a dielectric material with non-optimal parameters for use in high-frequency applications such as to support the antennae 120. An example of such a material is FR4. As will be apparent, although such materials may be low-cost, the properties of FR4 (e.g. relatively elevated dielectric constant and relatively elevated dissipation factor) may cause the loss of transmission and reception power on the order of about 0.25 dB per millimeter of signal path length. Antenna elements (e.g. the elements 124) may be particularly sensitive to such losses. Therefore, the length of the primary feed lines 212, in some examples, are preferably below about 4 mm. Further, the distance between the antenna elements 124 is preferably greater than about one third of the minimum operational wavelength emitted and received by the antenna elements 124.

Figure 3:
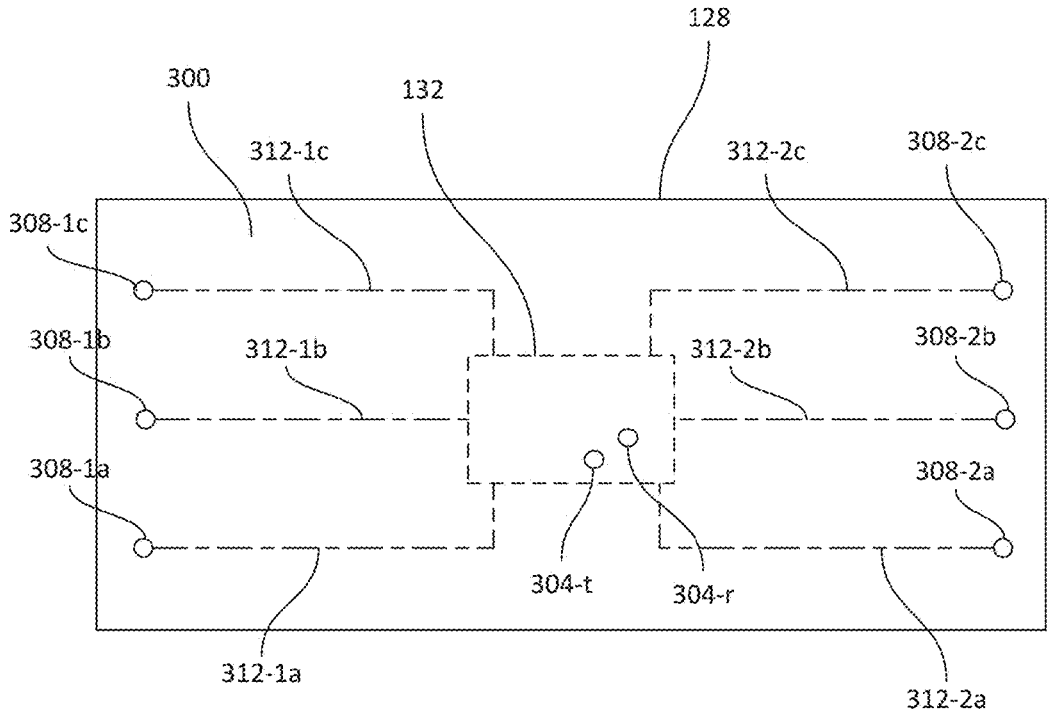
FIG. 3 depicts a bottom view of the secondary support member of the wireless communications assembly of FIG. 1.

Turning now to FIG. 3, the secondary support member 128 is shown from the opposite side as shown in FIGS. 1 and 2. In other words, the underside of the secondary support member 128 (which is connected to the primary support member 108 in FIG. 1) is shown in FIG. 3. The radio controller 132 is shown in dashed lines for illustrative purposes, as it will be apparent that in the orientation shown in FIG. 3, the radio controller is "behind" the secondary support member 128.

As seen in FIG. 3, the secondary support member 128 includes a secondary mounting surface 300. In the present example, the secondary mounting surface 300 is defined as the entire visible surface of the secondary support member 128. In other examples, however, the secondary mounting surface 300 is defined as a portion of the surface of the secondary support member 128 visible in FIG. 3. The secondary mounting surface 300 is configured to engage with the primary mounting surface, for example via the BGA package mentioned earlier. As a result, the secondary mounting surface 300 typically, though not necessarily, has the same dimensions as the primary mounting surface 200.

The secondary mounting surface 300 includes a third set of electrical contacts 304, and a fourth set of electrical contacts 308, also referred to herein as ports 308 for greater clarity. More specifically, as seen in FIG. 3, the contacts 304 include a contact 304-*r* and a contact 304-*t*; as will now be apparent, the positions of the contacts 304 align with those of the contacts 204 discussed earlier. The ports 308, meanwhile, include ports 308-1*a*, 308-1*b*, 308-1*c*, 308-2*a*, 308-2*b* and 308-2*c*. The contacts 304 and 308 are conductive features on the second mounting surface 300 (i.e., on the outer surface of the secondary support member 128 and within the perimeter of the secondary mounting surface 300) that connect to conductive traces within the secondary support member 128, as will be discussed below. The contacts 304 and 308 can be implemented, for example, as pads etched from a conductive layer or deposited on the secondary mounting surface 300. The ports 308 corresponding to each antenna 120 are preferably spaced apart by at least about one third of the minimum operational wavelength emitted and received by the antenna elements 124. Thus, the ports 308-1*a*, 308-1*b* and 308-1*c*, for example, are spaced apart from each other by about one third of the above-mentioned wavelength. Such separation of the ports 308 may permit the deployment of shorter primary feed lines 212 than if the ports 308 are disposed more closely together.

The secondary support member 128 further includes a set of secondary signal paths connecting the third set of electrical contacts 304 and the radio controller 132. In FIG. 3, the secondary signal paths are assumed to travel perpendicularly to the secondary mounting surface 300 to the radio controller 132, and are therefore not visible as their entire lengths lie "behind" the contacts 304. In other examples, however, the secondary signal paths may take any of a wide variety of trajectories through the secondary support member 128 to connect the contacts 304 and the radio controller 132. As will now be apparent, the secondary signal paths, together with the contacts 304, the contacts 204 and the primary signal paths 116, serve to connect the radio controller 132 with the baseband controller 112.

The secondary support member 128 also includes a set of secondary feed lines 312; in particular, the secondary feed lines 312 include feed lines 312-1*a*, 312-1*b*, 312-1*c*, 312-2*a*, 312-2*b*, and 312-2*c* in the present example. Each secondary feed line 312 electrically connects the radio controller 132 with a corresponding one of the ports 308.

As will be apparent, the primary and secondary mounting surfaces 200 and 300 may include a variety of other contacts, and the primary and secondary support members 108 and 128 can include a variety of other signal paths, all of which are not shown for greater simplicity and clarity of illustration. For example, the mounting surfaces 200 and 300 may include corresponding power supply contacts, ground contacts, and the like.

Figure 4:
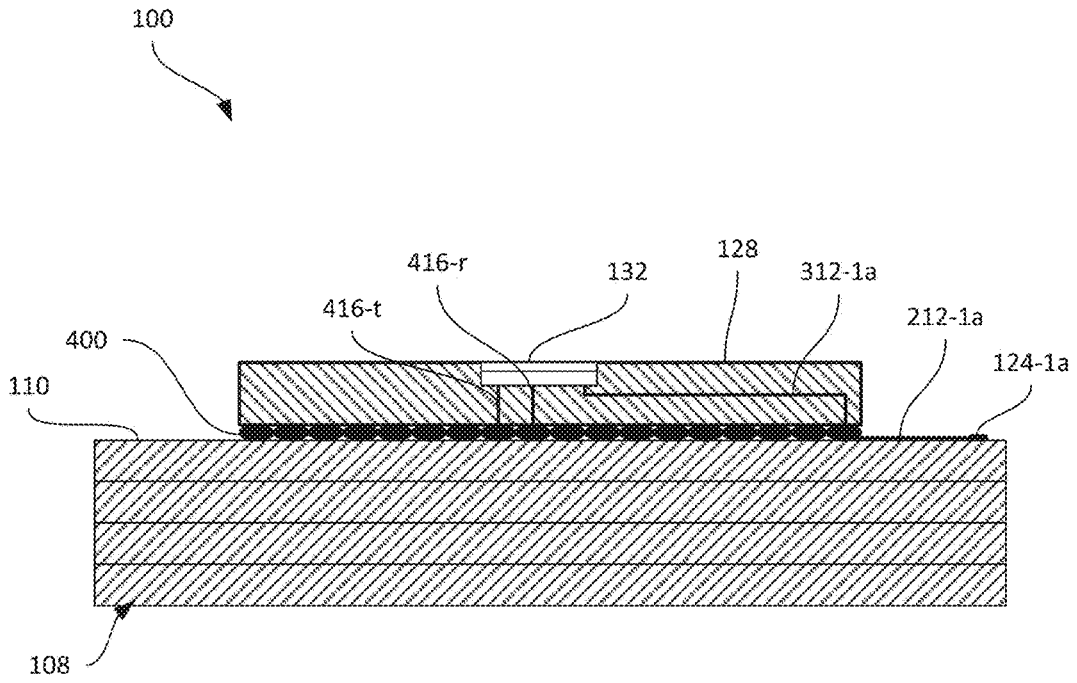
FIG. 4 depicts a cross-sectional view of the wireless communications assembly of FIG. 1.

As noted above, the secondary mounting surface 300 is configured to engage with the primary mounting surface 200. As will be apparent, and as shown in FIG. 4 (which illustrates a cross-section of the assembly 100 taken in the plane "A-A" shown in FIG. 1), when the mounting surfaces 200 and 300 are engaged, for example via a BGA mount 400, each antenna element 124 (element 124-1*a* is shown as an example in FIG. 4) is connected to the radio controller via the corresponding primary feed line 212, contact 208, port 308 and secondary feed line 312. Further, the baseband controller 112 and the radio controller 132 are interconnected by the primary signal paths 116, the contacts 204, the contacts 304, and the above-mentioned secondary signal paths (which are illustrated as secondary signal paths 416-*t* and 416-*r* in FIG. 4).

As will therefore be apparent, the secondary support member 128 may be considered an interposer carrying the radio controller 132, and relaying data between the radio controller 132 and the baseband controller 112 as well as receiving data from and transmitting data to the antennae 120. Of particular note, the secondary feed lines 312 have a greater length than the primary feed lines 212. In some examples, the secondary support member 128 is fabricated employing layers of a dielectric material selected for high performance in high-frequency applications such as wireless communications (e.g. at frequencies around 60 GHz). An example of such a material is Megtron. As will be apparent, such materials typically have relatively low dielectric constants in comparison to the material employed for the primary support member 108. The material employed for the secondary support member 128 also has a relatively low dissipation factor in comparison with the material employed for the primary support member 108. As a result, despite the greater length of the secondary feed lines 312 relative to the primary feed lines 212, losses incurred within the secondary support member 128 are typically lower than those incurred over the length of the primary feed lines 212. Together, the losses incurred over the total length of each primary and secondary feed line (e.g. the feed lines 212-1*a* and 312-1*a*) is maintained below a predetermined level (e.g. about 2 dB in some examples; about 1 dB in other examples) by deploying a greater portion of the total length within the secondary support member 128 than the primary support member 108).

Figure 5A:
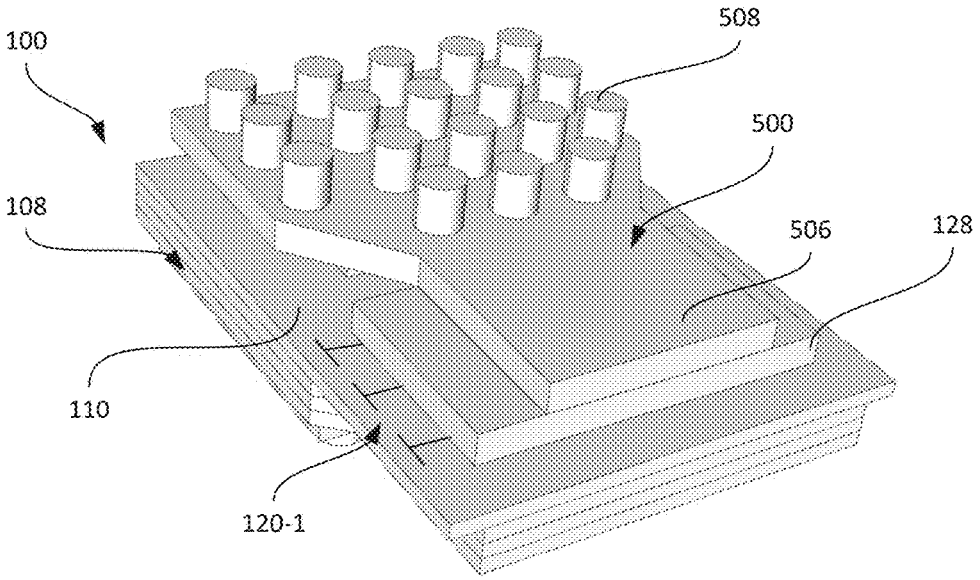
FIGS. 5A-5B depict top and bottom perspective views of a wireless communications assembly.
Figure 5B:
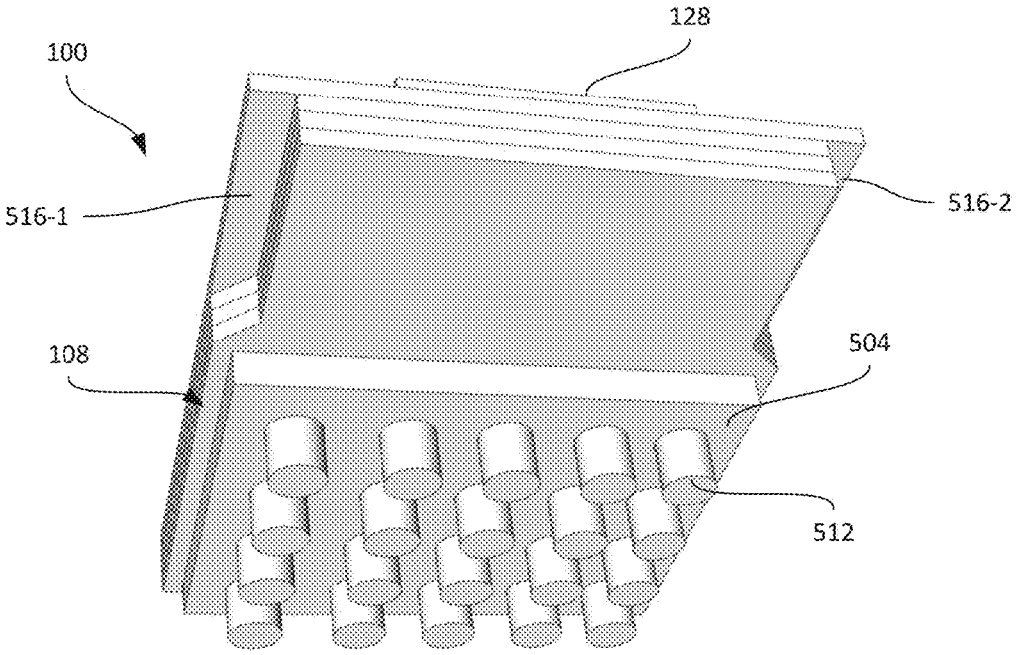

Referring now to FIGS. 5A and 5B, in some examples the assembly 100 also includes one or more heatsinks to dissipate heat generated during the operation of the assembly 100. In particular, the assembly 100 can include one or both of an upper heatsink 500 and a lower heatsink 504. The upper heatsink 500 includes a plate of thermally conductive material (e.g., aluminum) fixed to one or more of the secondary support member 128 (preferably so as to contact the radio controller 132) and the baseband controller 112. The heatsink 500 may also contact the communications interface 104. In the present example, the heatsink 500 includes a narrowed portion 506 over the portion of the primary support member 108 supporting the antenna 120, to reduce interference with antenna 120 performance, particularly when the heatsink material is electrically conductive. Similarly, as seen in FIG. 5B, the heatsink 504 may extend along only a portion of the surface opposite the outer surface 110, leaving the side of the primary support member 108 directly opposite the primary mounting surface 200 free of heatsink material.

The heatsinks 500 and 504 may both include one or more additional heat dissipation units, such as posts 508 and 512. The above-mentioned portion 506 of the heatsink 500 may omit the posts 508 to reduce the likelihood of interference with antenna 120 performance.

In some examples, the primary support member 108 can also include one or more cutouts 516, in which regions of one or more layers of the primary support member 108 below the layer supporting the antennae 120 are removed, to reduce potential interference with antenna performance. In the present example, in which the antenna elements 124 are supported on an upper layer of the primary support member 108 (i.e. the layer defining the outer surface 110), a region of each of the remaining three layers directly opposite the antenna elements 124 is cut away. In other examples, fewer layers may be cut away. The shape of the cutouts may also vary, and each cutout may be implemented as a plurality of cutouts (e.g. one smaller cutout under each individual antenna element 124)

Testing of a prototype wireless communications assembly (implementing the WiGig standard) constructed according the teaching herein yielded acceptable performance results. In particular, the prototype employed primary feed lines 212 with lengths of less than 4 mm and widths of about 120 μm. The layer thickness for the primary support member 108 was 76 μm, and the cutouts shown in FIGS. 5A and 5B were employed (in particular, the lower three layers of a five-layer primary support member 108 were cut away).

Figure 6A:
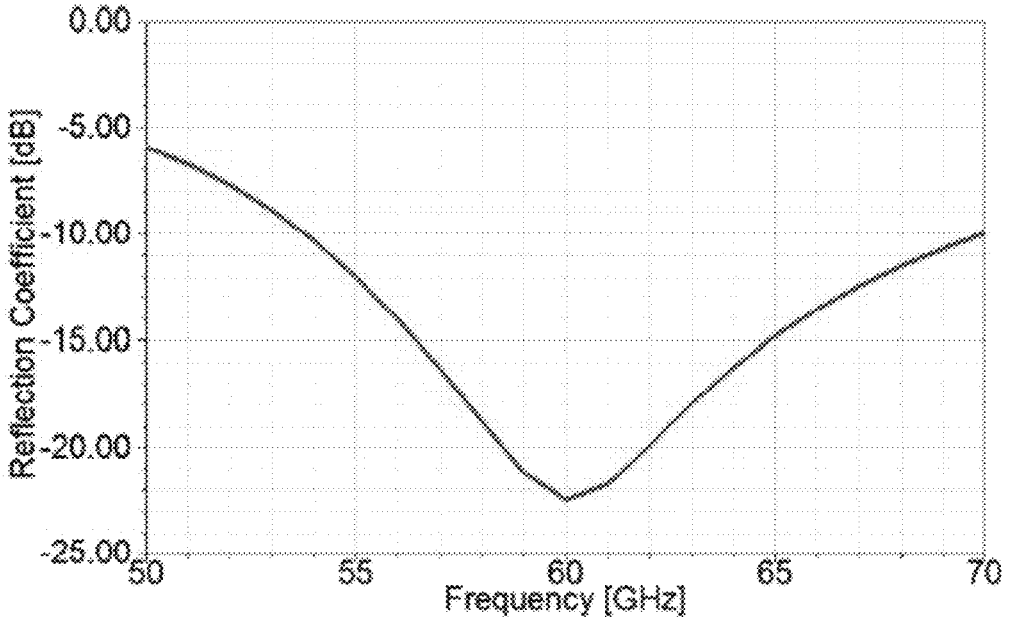
FIGS. 6A-6B, 7, 8A-8D and 9A-9D depict performance results for a prototype of the wireless communications assembly of FIGS. 5A-5B.
Figure 6B:
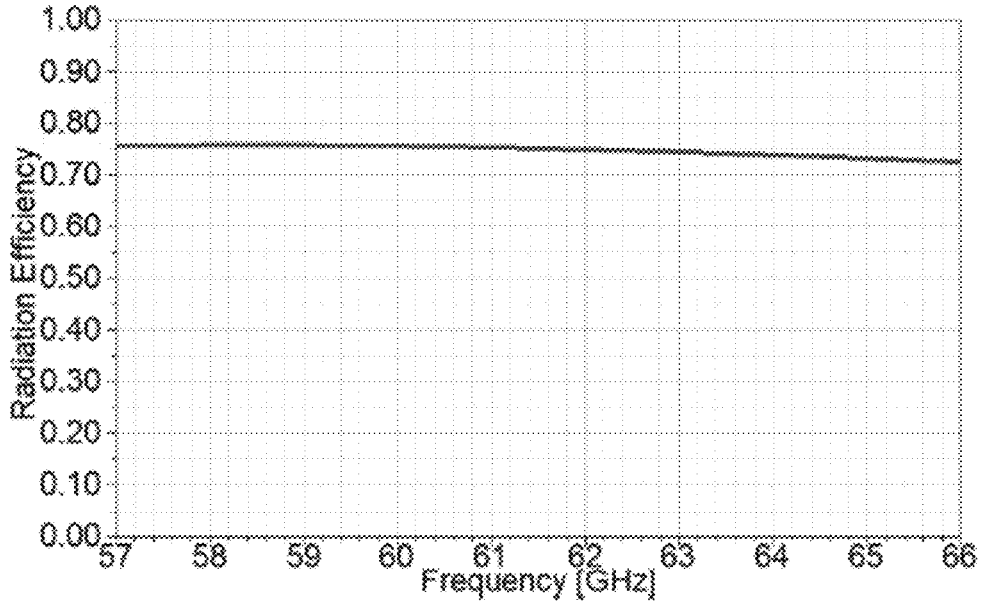
Figure 7:
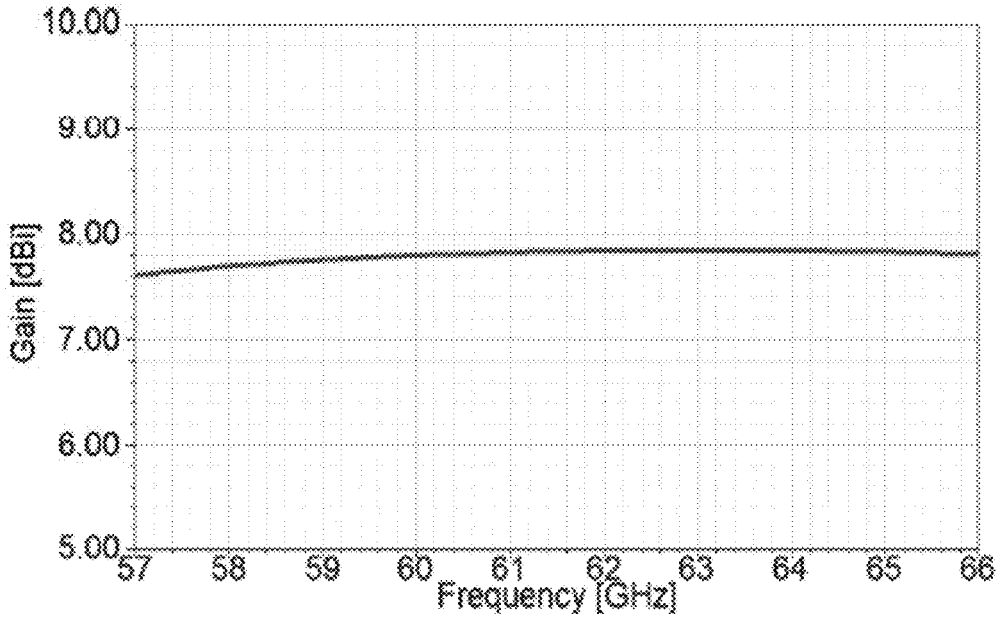
Figure 8A:
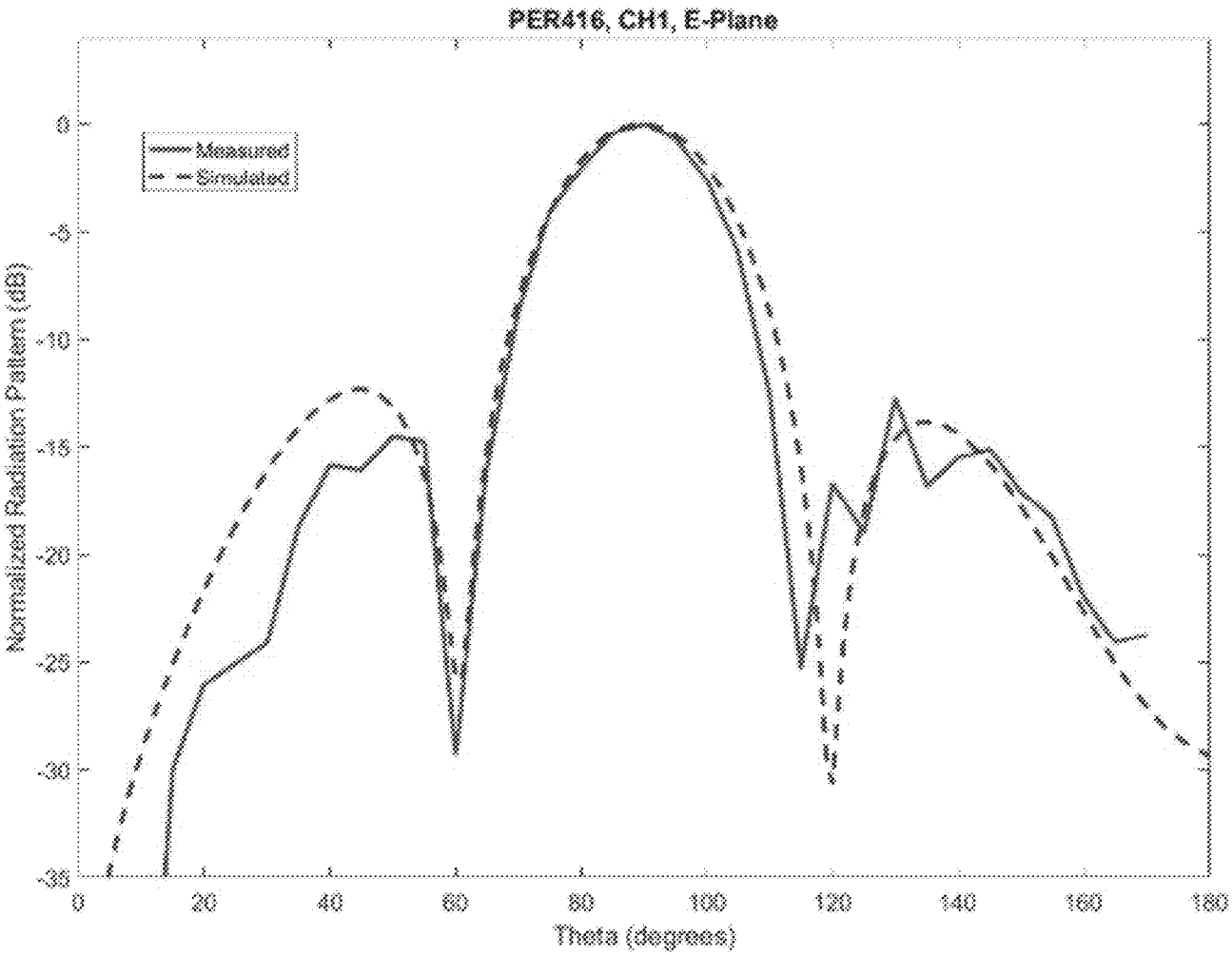
Figure 8B:
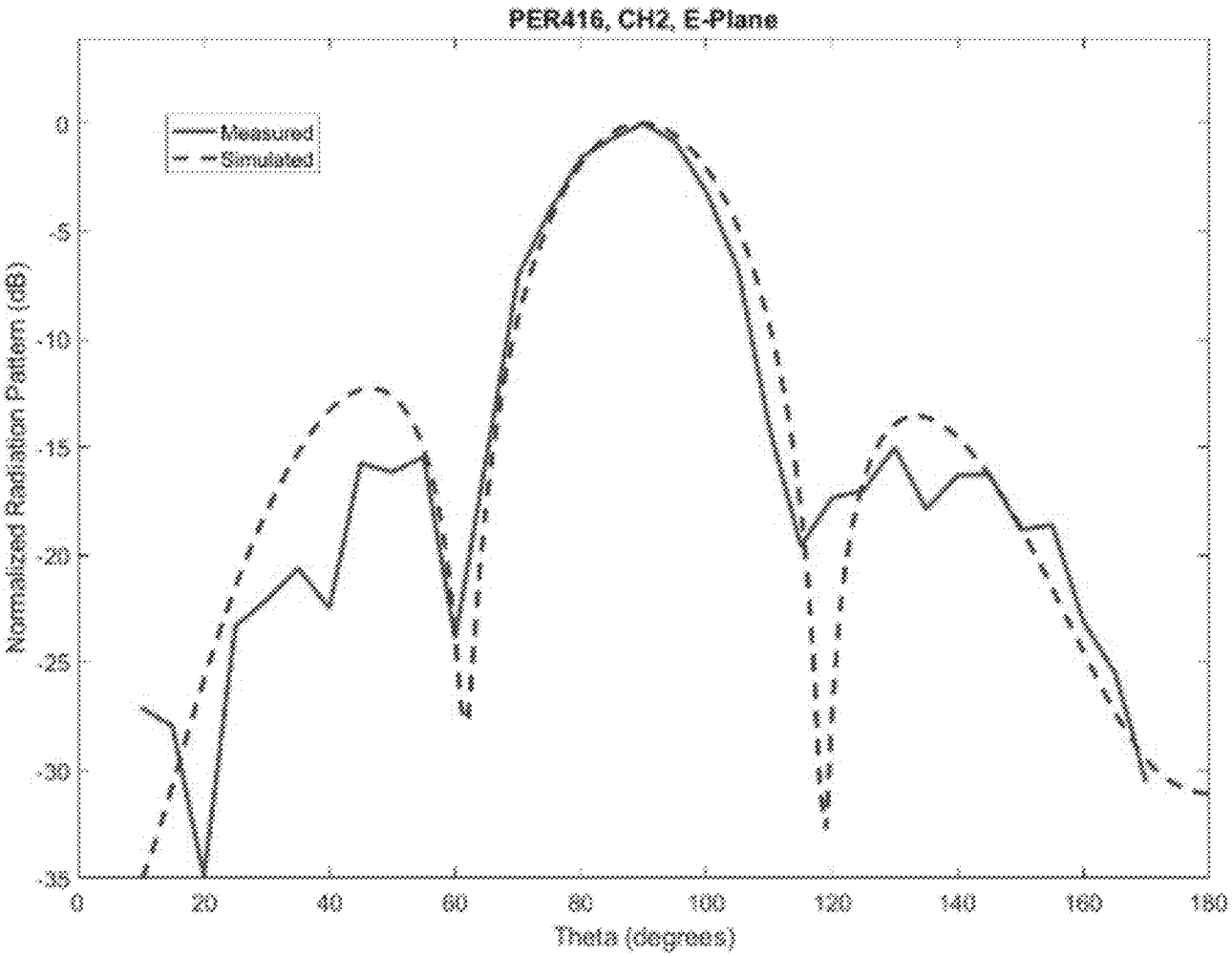
Figure 8C:
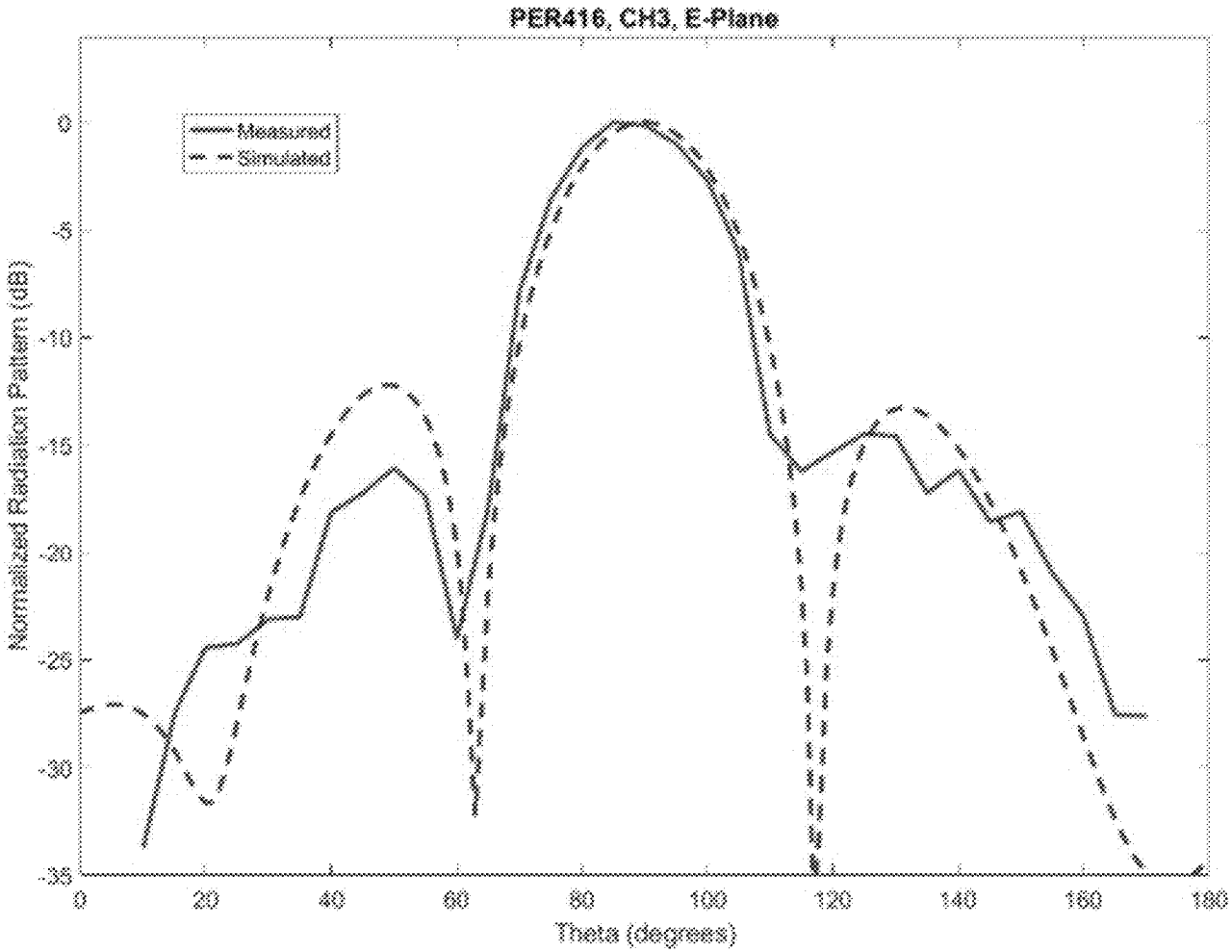
Figure 8D:
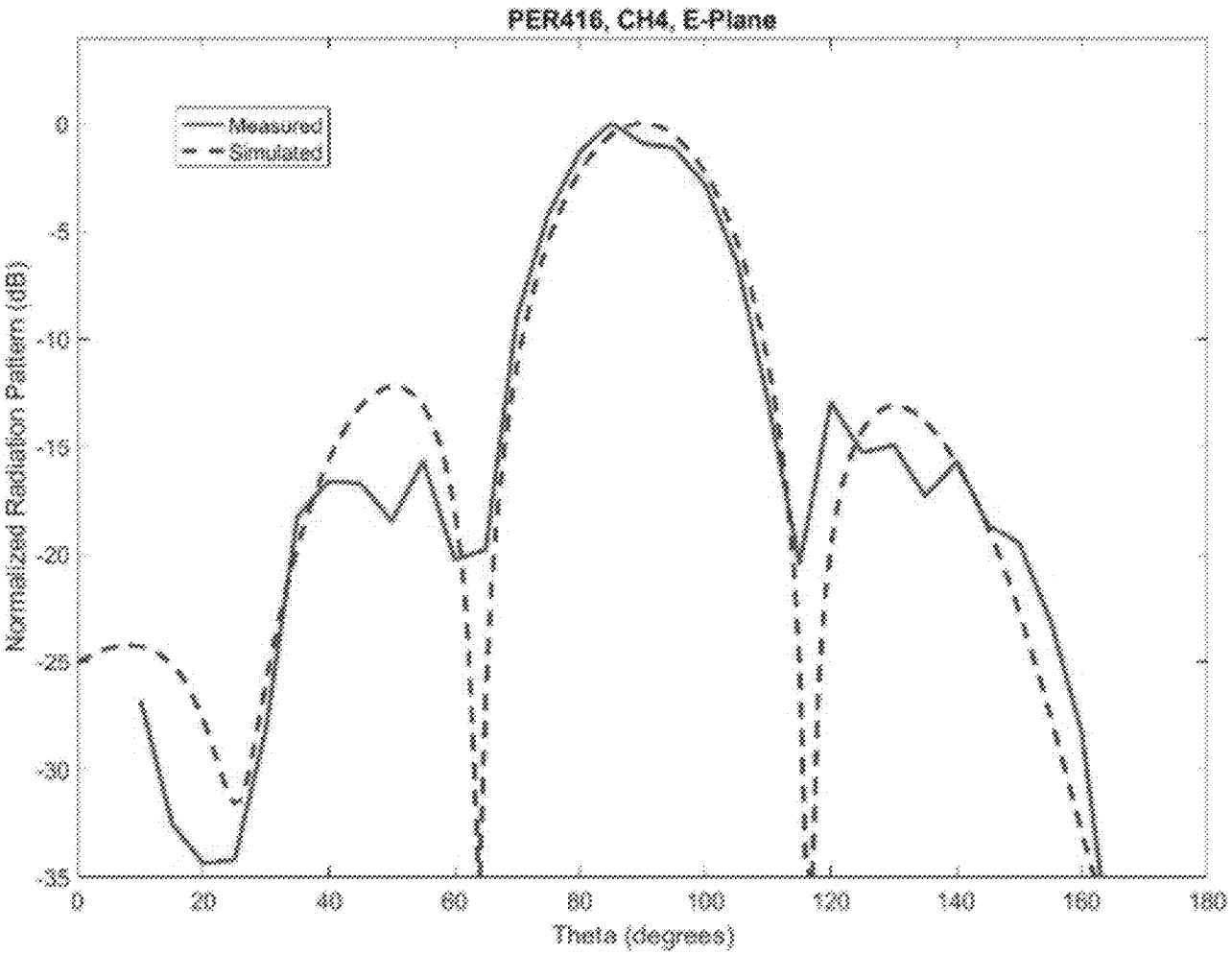
Figure 9A:
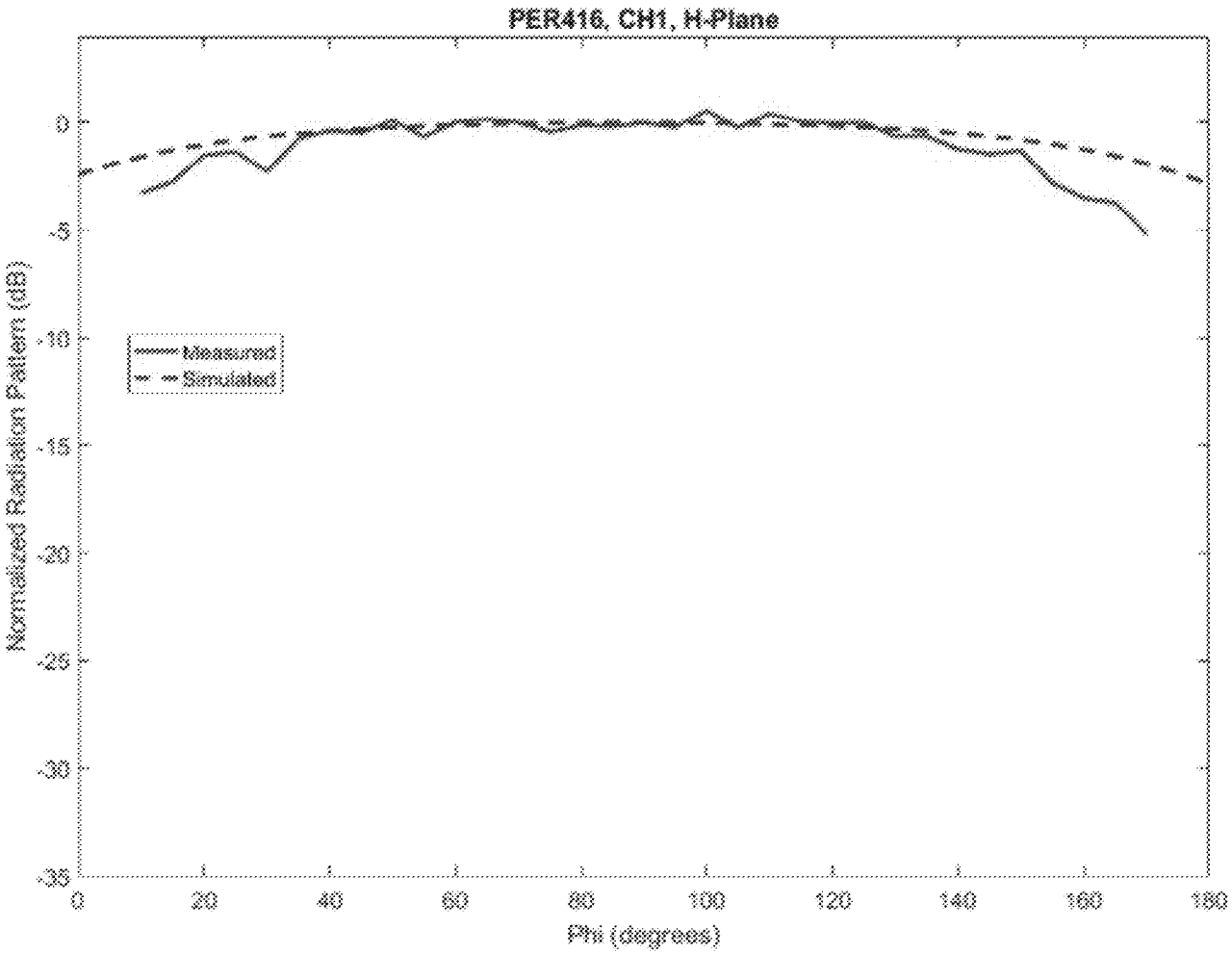
Figure 9B:
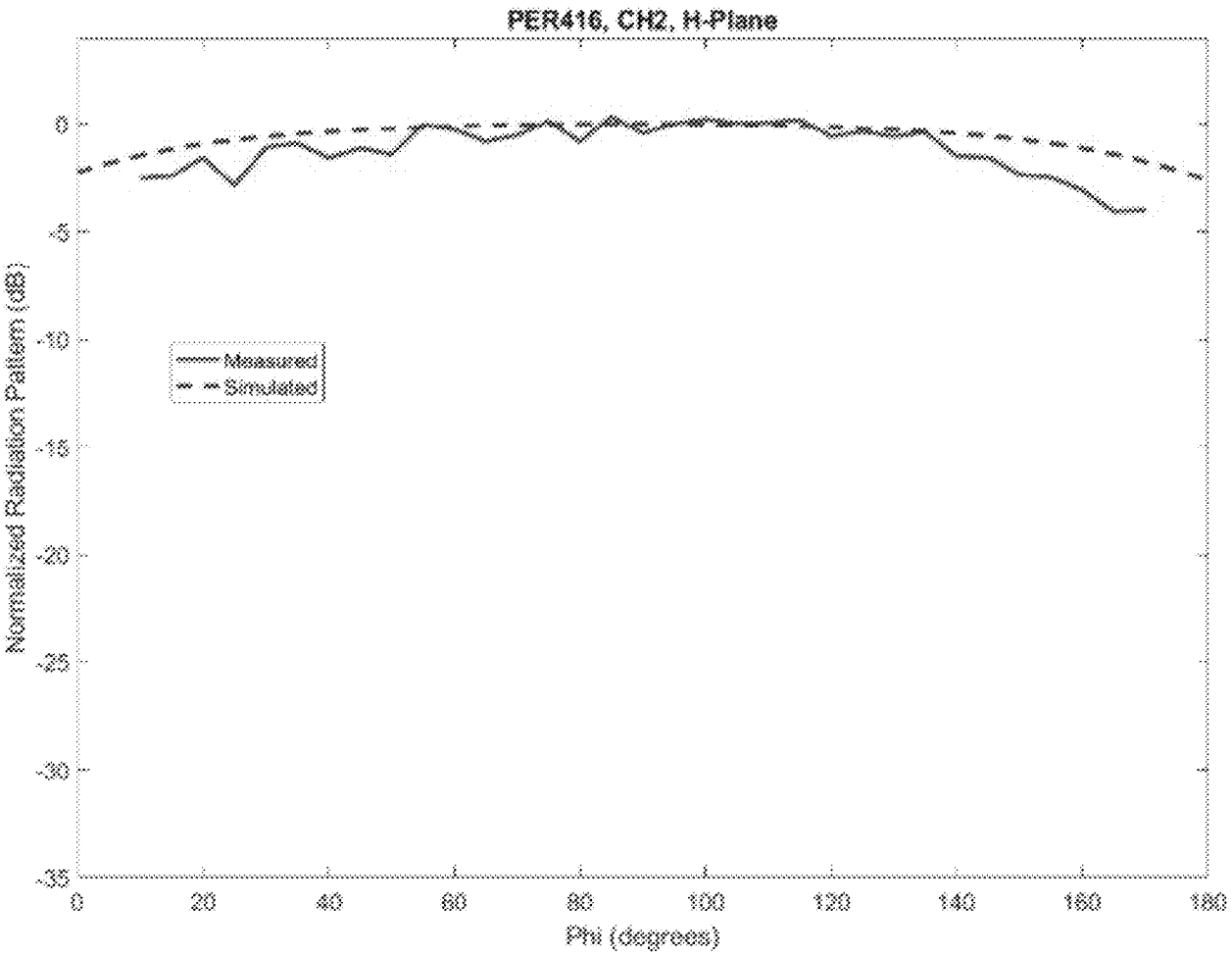
Figure 9C:
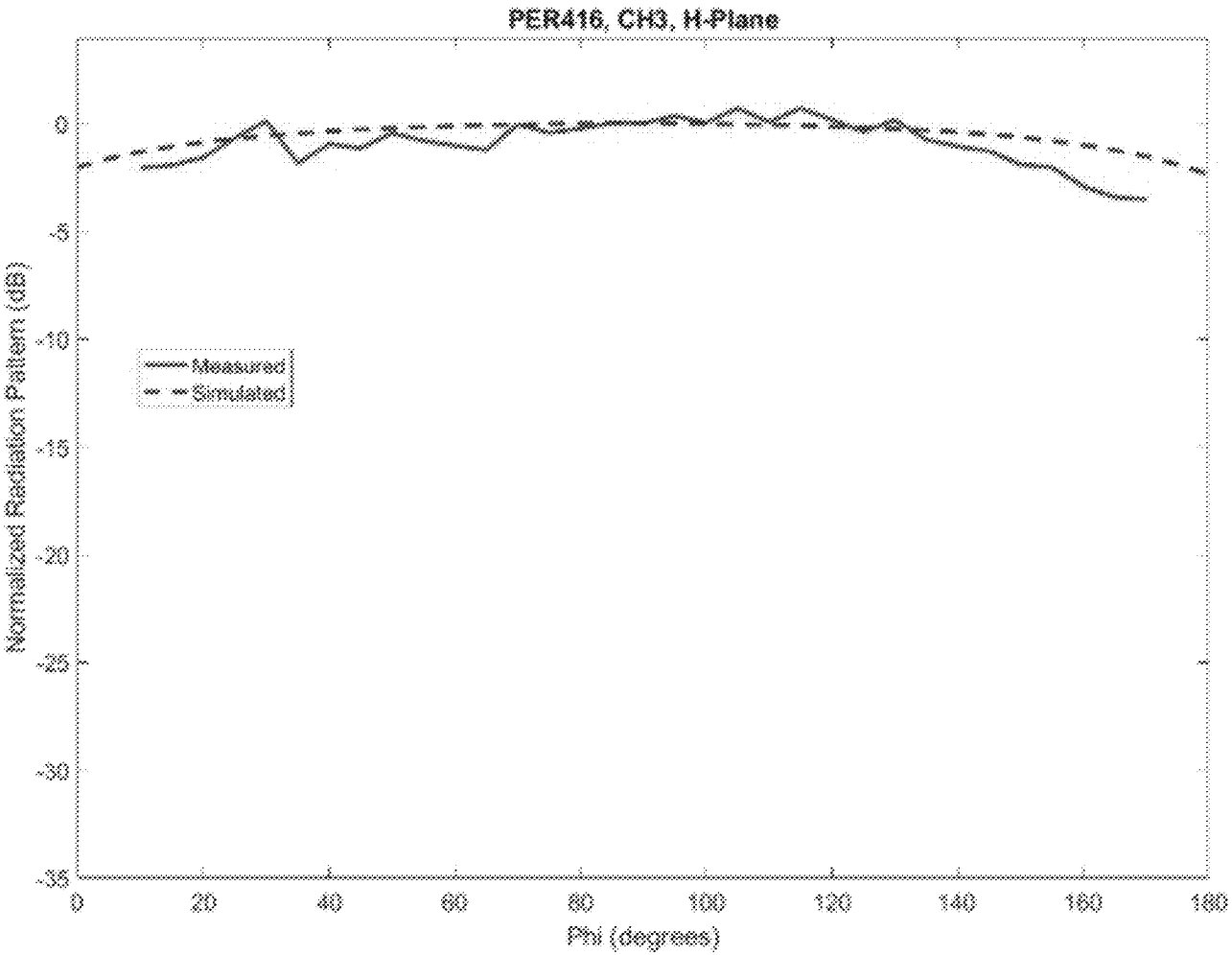
Figure 9D:
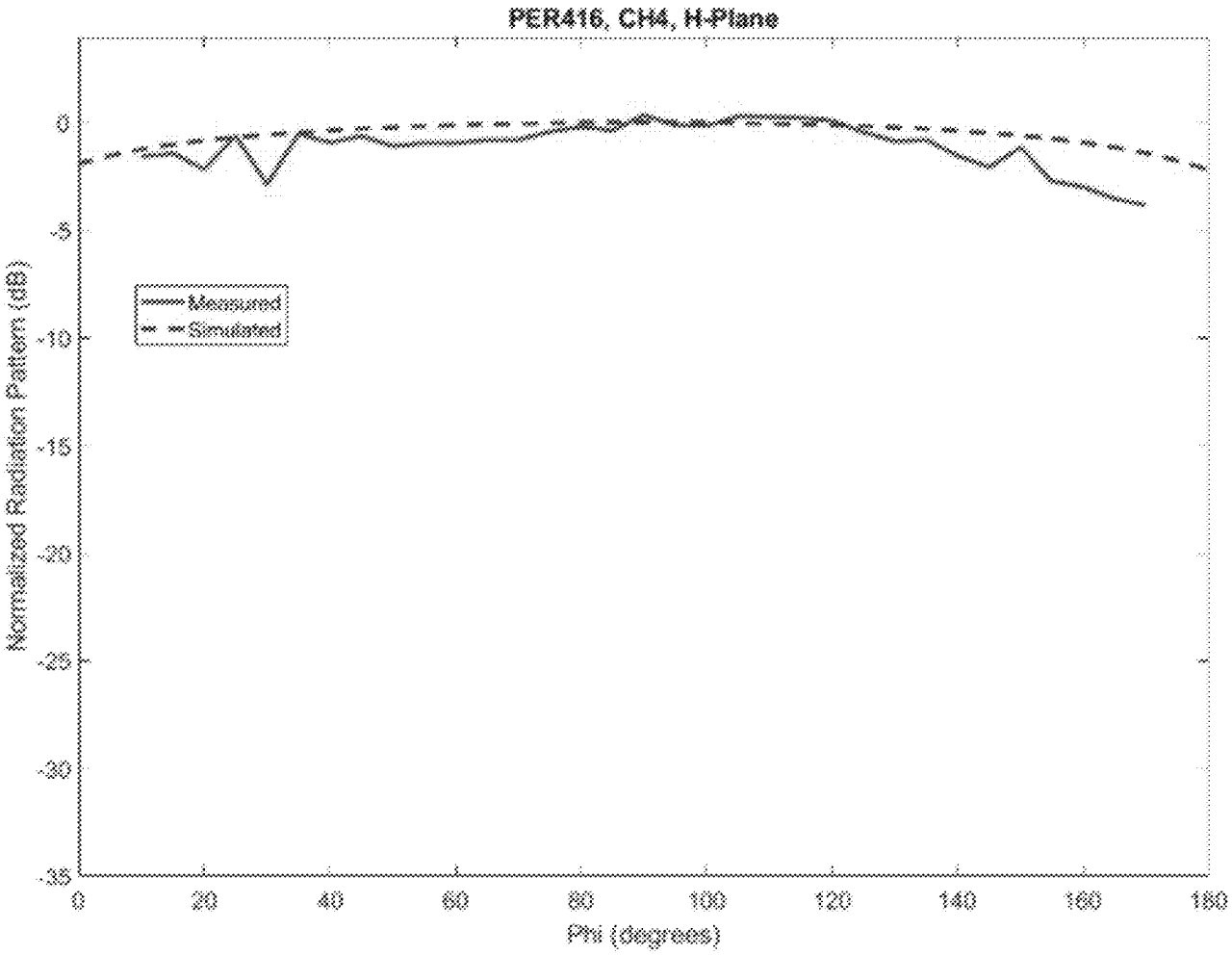

FIGS. 6A and 6B illustrate, respectively, the reflection coefficient and radiation efficiency of the prototype wireless communications assembly noted above, indicating (i) reduced reflection around 60 GHz, as required for operation at WiGig frequencies, and (ii) substantially constant efficiency between about 57 GHz and about 66 GHz. FIG. 7 illustrates the peak gain achieved by the prototype assembly over the WiGig frequency band. FIGS. 8A-8D depict measured and simulated radiation patterns for the prototype assembly in the E-plane at each of the four standard WiGig channels. FIGS. 9A-9D, meanwhile, illustrates measured and simulated radiation patterns for the prototype assembly in the H-plane at each of the four standard WiGig channels.

The scope of the claims should not be limited by the embodiments set forth in the above examples, but should be given the broadest interpretation consistent with the description as a whole.

The invention claimed is:

1. A wireless communications assembly, comprising:

a primary support member defining a primary mounting surface; the primary mounting surface having a first set of electrical contacts and a second set of electrical contacts;

an antenna supported on the primary support member adjacent to a perimeter of the primary mounting surface;

a set of primary feed lines defined by the primary support member between the second set of electrical contacts and the antenna;

a secondary support member carrying a radio controller and defining a secondary mounting surface; the secondary mounting surface having a third set of electrical contacts and a set of ports adjacent to a perimeter of the secondary mounting surface;

a set of signal paths defined by the secondary support member between the third set of electrical contacts and the radio controller;

a set of secondary feed lines defined by the secondary support member between the radio controller and the set of ports;

the secondary mounting surface configured to engage with the primary mounting surface to connect the first set of electrical contacts with the third set of electrical contacts, and the second set of electrical contacts with the set of ports.

2. The wireless communications assembly of claim 1, wherein the second set of electrical contacts is adjacent to the perimeter of the primary mounting surface.

3. The wireless communications assembly of claim 1, further comprising: a baseband controller supported on a common side of the primary support member with the primary mounting surface.

4. The wireless communications assembly of claim 1, wherein the antenna is integrated with the primary support member.

5. The wireless communications assembly of claim 1, wherein the antenna includes a phased array comprising a plurality of antenna elements.

6. The wireless communications assembly of claim 5, wherein the ports are spaced apart by at least one third of an operational wavelength of the antenna.

7. The wireless communications assembly of claim 1, wherein each of the secondary feed lines have a greater length than each of the primary feed lines.

8. The wireless communications assembly of claim 7, wherein each of the primary feed lines have a length of less than 4 mm.

9. The wireless communications assembly of claim 1, wherein the secondary support member comprises an interposer, and wherein the radio controller is integrated with the interposer.

10. The wireless communications assembly of claim 1, wherein the primary support member comprises a first substrate material, and wherein the secondary support member comprises a second substrate material.

11. The wireless communications assembly of claim 10, wherein the second substrate material has one or more of (i) a lower dielectric constant than the first substrate material, and (ii) a lower dissipation factor than the first substrate material.

12. The wireless communications assembly of claim 1, wherein the antenna is adjacent to a perimeter of the primary support member.

13. The wireless communications assembly of claim 1, wherein the antenna is supported on a first side of the primary support member; and wherein the primary support member includes a cutout on a side opposite the antenna.

14. The wireless communications assembly of claim 13, wherein the primary support member is a multi-layer printed circuit board (PCB); wherein the antenna is carried on an outer layer, and wherein the cutout is defined through a plurality of remaining layers.

15. The wireless communications assembly of claim 1, further comprising a heatsink affixed to the baseband controller and the secondary support member to contact the radio controller.

16. The wireless communications assembly of claim 15, the heatsink comprising a narrowed portion adjacent the antenna.

17. The wireless communications assembly of claim 3, further comprising a communications interface connected with the baseband controller.

18. A primary support member for a wireless communications assembly, comprising:

a primary mounting surface having a first set of electrical contacts and a second set of electrical contacts;

an antenna supported adjacent to a perimeter of the primary mounting surface;

a set of primary feed lines between the second set of electrical contacts and the antenna;

the primary mounting surface configured to engage with a secondary support member carrying a radio controller and having (i) secondary feed lines and a corresponding set of ports to connect the antenna to the radio controller via the second set of electrical contacts and the primary feed lines, and (ii) signal paths connecting the radio controller to a third set of electrical contacts.

19. The primary support member of claim 18, wherein the electrical contacts of the second set are spaced apart by at least one third of an operational wavelength of the antenna.

20. The primary support member of claim 18, wherein the antenna is adjacent to a perimeter of the primary support member.

* * * * *